US005743121A

United States Patent [19]

Miller

[11] Patent Number: 5,743,121

[45] Date of Patent: Apr. 28, 1998

[54] REDUCIBLE GLASS LUBRICANTS FOR METALWORKING

[75] Inventor: Mark Lloyd Miller, Schenectady, N.Y.

[73] Assignee: General Electric Company, Schenectady, N.Y.

[21] Appl. No.: 655,544

[22] Filed: May 31, 1996

[51] Int. Cl.[6] ..... B21B 45/02

[52] U.S. Cl. ..... 72/42; 508/136

[58] Field of Search ..... 72/42, 46, 41, 72/47, 39; 508/136, 141, 102; 427/287, 284, 318, 376.2

[56] References Cited

U.S. PATENT DOCUMENTS

| | | | |
|---|---|---|---|
| 3,840,461 | 10/1974 | Espunes | 72/42 |
| 4,110,487 | 8/1978 | Rion | 427/376.2 |
| 4,260,498 | 4/1981 | Sample, Jr. et al. | 252/28 |
| 4,374,168 | 2/1983 | Wojtowicz | 72/46 |
| 4,402,838 | 9/1983 | Eguchi et al. | 72/42 |
| 4,555,415 | 11/1985 | Mumford et al. | 427/376.2 |

*Primary Examiner*—Lowell A. Larson
*Assistant Examiner*—Rodney Butler
*Attorney, Agent, or Firm*—Tyler Maddry; Donald S. Ingraham

[57] ABSTRACT

A reducible glass lubricant on a metal workpiece provides a duplex film during hot working of the workpiece. A silicate glass powder which contains from about 3 to 50 mole percent of an oxide of bismuth, tin or copper is used for the reducible glass lubricant. During preheating in a preheat furnace the glass lubricant is reduced to the duplex glass film.

6 Claims, 1 Drawing Sheet

REDUCIBLE GLASS LUBRICANTS FOR METALWORKING

This invention relates to reducible glass lubricants for metalworking. More particularly, this invention is directed to a method of hot working a metal workpiece with a reducible glass lubricant thereon and to a metal workpiece with a reducible glass lubricant thereon.

Industries such as aircraft engine and turbine manufacturing employ hot metalworking operations such as extrusion and forging to produce high quality, near-net-shape parts with good quality surface finishes. Achieving the necessary degree of consistent surface and dimensional quality requires metalworking lubrication capable of providing protection for the highly finished and accurate dies. The processing involves repeated contact between these dies and the hot workpiece metals under very high pressures. Under these conditions the workpiece tends to wear the dies by such mechanisms as erosion, galling and abrasion. The workpiece metals employed, such as titanium alloys, are often especially prone to aggressive attack on the dies. Worn dies then produce parts of unacceptable quality.

Current practice in metalworking employs lubricant systems typically comprising a glass applied to the workpiece plus an accessory lubricant such as graphite applied to the dies. It has been found that glasses containing lead oxide are especially effective as lubricants for precision metalworking. However, the element lead is undesirable in an industrial process.

It is apparent from the above that there exists a need in the art for a method of hot working a metal with an improved lubricant thereon. It is a purpose of this invention to fulfill this and other needs in the art in a manner more apparent to the skilled artisan and given the following disclosure.

SUMMARY OF THE INVENTION

The above-mentioned needs are met by the present invention which relates to a method of hot working a metal workpiece or core having an improved reducible glass lubricant coating thereon. A metal workpiece is also disclosed with a reducible glass lubricant coating thereon. More particularly, the present method of hot working of a metal workpiece comprises providing a metal workpiece, providing a silicate glass powder containing from about 3 to 50 mole percent of an oxide of a metal in which the metal is selected from the class consisting of bismuth, tin and copper, coating the workpiece with the silicate glass powder providing a reducible glass lubricant, preheating the workpiece with the silicate glass powder thereon producing a duplex lubricant film, and hot working the workpiece to produce a near-net-shape part with a good quality finish.

In another embodiment, an article comprises a metal workpiece and a silicate glass powder thereon, the powder containing from about 3 to 50 mole percent of an oxide of a metal in which the metal is selected from the class consisting of bismuth and copper.

BRIEF DESCRIPTION OF THE DRAWINGS

The subject matter, which is regarded as the invention, is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
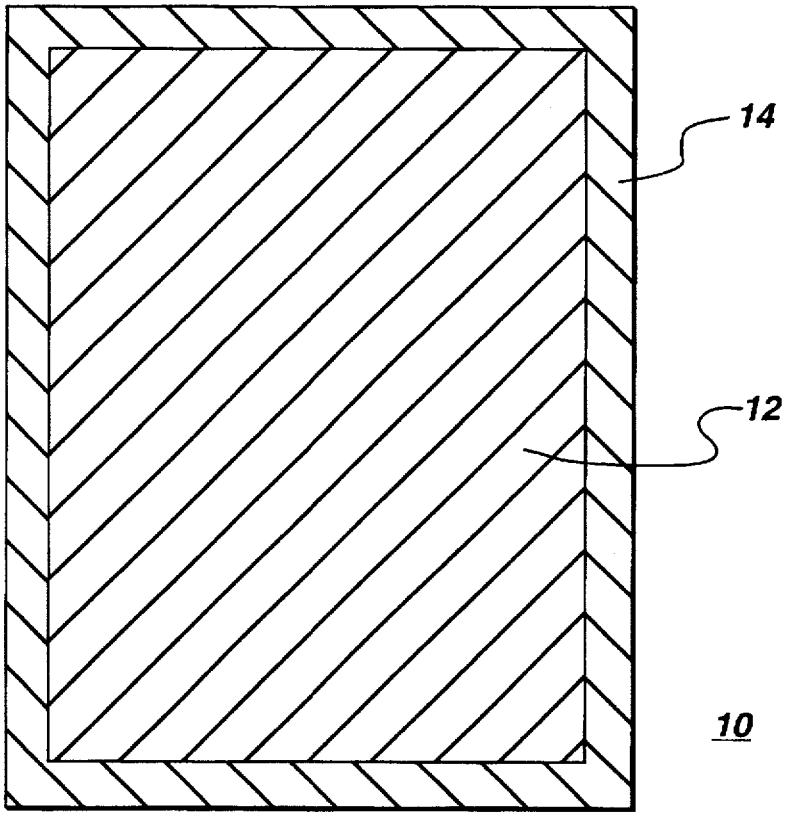
FIG. 1 is a sectional view of a metal workpiece with a reducible glass lubricant coating thereon for providing an article and for practicing the method of the present invention.

FIG. 1 shows an article 10 of the present invention which comprises a metal workpiece 12, for example, of titanium or titanium alloy with a reducible glass lubricant coating or layer 14 thereon. This article is suitable for practicing the present invention by being hot worked in operations such as extrusion and forging. The coating or layer is a silicate glass powder containing from about 3 to 50 mole percent of an oxide of a metal in which the metal is selected from the class consisting of bismuth, tin and copper. The glass powder coating is applied to the metal workpiece by dipping or spray coating. In the dipping operation, the glass powder is dispersed preferably in water plus dispersants, binders, and rheology agents to provide a slurry. The workpiece is dipped into the slurry to coat the glass powder on all the surfaces thereof. If desired, the glass powder is spray coated onto the surfaces of the workpiece. In this operation, the glass powder is dispersed preferably in water plus dispersants, binders, and rheology agents to provide an adherent coating. As shown in FIG. 1, the powder adheres to all of the workpiece surfaces. Article 10 is suitable for practicing the method of the present invention.

Figure 2:
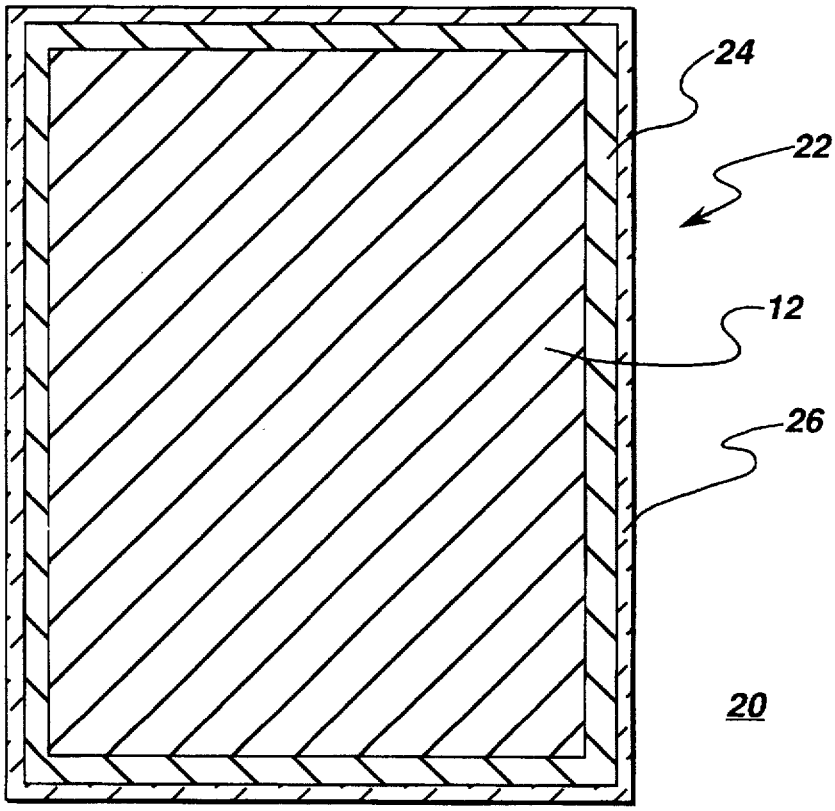
FIG. 2 is a sectional view of a preheated workpiece with a duplex lubricant coating or film thereon.

In FIG. 2, there is shown an article 20 which is an article such as article 10 shown in FIG. 1 after the article has been preheated in a pre-heat furnace. Article 20 comprises a metal workpiece 12 with a duplex film 22 thereon. Film 22 has two layers with inner layer or film of soft metal 24 adjacent to workpiece 12. Metal layer 24 may be in a molten state. An outer layer or film 26 of molten glass is adjacent metal layer 24. Article 20 is suitable for being hot worked in an extrusion or forging operation.

In the present invention, a method of hot working a metal workpiece or core 20 comprises providing a metal workpiece or core 12, for example, of titanium metal or alloy. An improved reducible glass lubricant coating is prepared from a silicate glass powder containing from 3 to 50 mole percent of an oxide of a metal in which the metal is selected from the class consisting of bismuth, tin and copper. The workpiece 12 is coated with the silicate glass powder to provide a reducible glass lubricant thereon. The glass powder is applied to the metal workpiece by dipping or spray coating. In the dipping operation, the glass powder is dispersed preferably in water plus dispersants, binders, and rheology agents to provide a slurry. The workpiece is dipped into the slurry to coat the glass powder on all the surfaces thereof. If desired, the glass powder is spray coated onto the surfaces of the workpiece. In this operation, the glass powder is dispersed preferably in water plus dispersants, binders, and rheology agents to provide an adherent coating.

The silicate glass powder coating is a reducible glass lubricant coating. The workpiece with the silicate glass powder coating or reducible glass lubricant is preheated in a pre-heat furnace to a sufficient temperature to reduce the reducible glass lubricant to a duplex lubricant on the surface of the workpiece. This duplex lubricant is produced by including the metal oxide of bismuth, tin or copper in the formation of the glass which is chemically reduced to the respective metal as a soft metal portion of the film adjacent the workpiece. The soft metal may be in a molten state. The glass portion of the film is in a molten state adjacent the soft metal portion. The glass portion is the outer portion of the duplex film.

The workpiece with the duplex film is generally prepared just prior to the hot working operation, such as extrusion or forging. As it is customary, there may also be employed customary die lubricants, such as graphite, applied to the dies. The preheated workpiece with duplex lubricant thereon is hot worked by extrusion or forging to produce high quality, near-net-shape parts with good quality surface finishes.

The foregoing has described a method of hot working of a metal workpiece and a metal workpiece with a reducible glass coating thereon. It will be apparent to those skilled in the art that various modifications thereto can be made without departing from the spirit and scope of the invention as defined in the appended claims.

What is claimed is:

1. A method of hot working a metal workpiece comprising the steps of:

providing a metal workpiece, providing a glass lubricant which comprises a metal oxide in which the metal is selected from the class consisting of bismuth, tin, and copper, coating said metal workpiece with said glass lubricant, reducing the metal oxide to form a duplex lubricant film, and hot working the metal workpiece to produce a near-net-shape part with a good quality finish.

2. A method of hot working a metal workpiece as in claim 1, wherein the step of providing a glass lubricant further includes providing a silicate glass powder containing from about 3 to 50 mole percent of the metal oxide.

3. A method of hot working a metal workpiece as in claim 1, wherein the step of reducing the metal oxide to form a duplex lubricant film further includes preheating the workpiece with the glass lubricant thereon.

4. A method of hot working a metal workpiece as in claim 1, wherein the step of reducing the metal oxide further includes forming a first layer of metal adjacent to the workpiece and an outer molten glass layer.

5. A method of hot working a metal workpiece comprising the steps of:

providing a metal workpiece, providing a silicate glass powder containing from about 3 to 50 mole percent of an oxide of a metal in which the metal is selected from the class consisting of bismuth, tin, and copper, coating the workpiece with the silicate glass powder, preheating the workpiece with the silicate glass powder thereon producing a duplex lubricant film, and hot working the workpiece to produce a near-net-shape part with a good quality finish.

6. An article comprising:

a metal workpiece, a reducible glass lubricant adhering to the surfaces of said metal workpiece, and said lubricant comprising a silicate glass powder containing from about 3 to 50 mole percent of an oxide of a metal selected from the class consisting of bismuth, tin and copper.

* * * * *